United States Patent [19]

Greenwald

[11] 4,094,396

[45] June 13, 1978

[54] CONTROL DEVICE FOR A COIN OPERATED MECHANISM

[75] Inventor: Harry Greenwald, Whitestone, N.Y.

[73] Assignee: Walter Kidde & Company, Inc., Clifton, N.J.

[21] Appl. No.: 774,963

[22] Filed: Mar. 7, 1977

[51] Int. Cl.[2] ..... G07F 15/12

[52] U.S. Cl. ..... 194/1 M

[58] Field of Search ..... 194/92, 9 T, 9, 1 M, 194/DIG. 1; 200/61.39

[56] References Cited

U.S. PATENT DOCUMENTS 3,208,572 9/1965 Jensen ..... 194/1 M

*Primary Examiner*—Stanley H. Tollberg

*Attorney, Agent, or Firm*—McAulay, Fields, Fisher & Goldstein

[57] ABSTRACT

A control device for a coin operated mechanism wherein the duration of the operating cycle of the mechanism is determined by the number of coins deposited in the device. Restraining structure is provided in the control device to prevent the inadvertent initiation of the operating cycle after the mechanism has completed a cycle of operation, or to prevent the unauthorized initiation of said operating cycle without first depositing the proper number of coins in the device.

5 Claims, 7 Drawing Figures

CONTROL DEVICE FOR A COIN OPERATED MECHANISM

BACKGROUND OF THE INVENTION

1. Field of the Invention

This invention relates, generally, to coin operated mechanisms and, more particularly, to a control device for preventing the inadvertent or unauthorized initiation of the operating cycle of said mechanism.

2. Description of the Prior Art

Coin operated mechanisms of the type commonly referred to as commercial appliances, such as, clothes washers and dryers, are usually provided with rotary coin meters or coin slide assemblies which require the insertion of one or more coins to initiate the operating cycle of the mechaism. The length or duration of the operating cycle is controlled by an electrically operated timer which is part of the control device. Examples of such prior art control devices are disclosed in U.S. Pat. Nos. 2,915,692; 3,168,947; 3,172,520 and 3,614,681.

In one form of such control device, a ratchet wheel and a star wheel are rotatably mounted on a common shaft. Each of said wheels carries an eccentrically mounted pin located at an equal radial distance from the axis of the shaft. The pins project toward one another and are adapted to engage upon rotation of one wheel relative to the other. The ratchet wheel is driven or stepped by a pawl assembly which, in turn, is operatively associated with either a coin slide assembly or solenoid assembly. In either case, deposit of a proper coin in the device permits the coin slide or solenoid to operatively move the pawl assembly in a manner to stepwise rotate the ratchet wheel in one direction a distance of one tooth. Such rotation establishes an angular separation between the pins of the ratchet wheel and the star wheel. A spring biased arm is provided which operatively connects the rachet wheel to a switch. The operation is such that rotation of the ratchet wheel effects movement of the arm to a position which, in turn, effects movement of the switch to a closed state to initiate the operating cycle of the mechanism.

Movement of the switch to its closed state also serves to energize an electrically operated timer which, in turn, effects rotation of a pin wheel attached to the timing motor shaft. Rotation of the pin wheel causes the pins thereof to engage with the teeth of the star wheel and intermittently rotate said star wheel in the same direction of rotation of the ratchet wheel. Rotation of the star wheel causes the pin thereof to engage with the pin of the ratchet wheel. Continued rotation of the pin wheel effects conjoint rotation of the star wheel and the ratchet wheel in said one direction, dur to the engagement of said pins, and serves to displace the switch operating arm to a position to effect movement of the switch to its open state to de-energize the timer and terminate the operating cycle of the mechanism.

In the device as described above, it is possible for the star wheel to counterrotate in a direction opposite to said one direction when the switch is in its open state. Such counterrotation of the star wheel permits the ratchet wheel to similarly counterrotate in said opposite direction under the influence of the spring biased switch arm. However, the counterrotation of the ratchet wheel due to the movement of the switch arm also effects movement of the switch to its closed state to thereby inadvertently initiate the operating cycle of the mechanism. Thus, the mechanism may be subjected to unauthorized use without first depositing the proper coin or coins in the control device.

The extent to which the star wheel can counterrotate is a function of the rotational play of said wheel and the rotational play of the timer pin wheel. However, it only takes a slight degree of rotational play to inadvertently initiate the operating cycle of the mechanism. In practice, it has been found that a slight jar of the control device was all that was necessary to initiate the operating cycle. In other instances, the mere force being exerted by the spring biased switch arm on the ratchet wheel was sufficient to effect the degree of counterrotation necessary of said ratchet wheel and said star wheel to initiate said operating cycle.

Heretofore, restraining means have been proposed to prevent the inadvertent initiation of the operating cycle of the mechanism. For example, in U.S. Pat. No. 2,915,692, the means for stepping the ratchet wheel comprised an oscillatably mounted spring biased operating arm having a spring wire that was positioned to slip over one tooth of the wheel upon advanced movement of said arm. The movement of the operating arm was effected by the projected movement of the coin slide to its operate position. The arrangement was such that, upon retracted movement of the coin slide, the arm returned to its original position which, in turn, caused the bent end of the wire to rotate the ratchet wheel by a distance of one tooth.

In order to prevent forceful turning of the timer control knob with the resulting damage to the spring wire, a bracket was provided having a portion overlying the surface of the teeth of the ratchet wheel. The bracket was positioned such that, in the spring retracted position of the operating arm, the bracket engaged the bent wire end and reinforced it in a manner to block or prevent counterrotation of the ratchet wheel. While such restraining means proved satisfactory for the specific structure disclosed in said patent, the arrangement is not suitable for newer control devices incorporating different means for stepping the ratchet wheel. The present invention provides improved restraining means, as hereinafter disclosed, to prevent the counterrotation of the star wheel and the ratchet wheel when the switch is in its open state.

SUMMARY OF THE INVENTION

The control device of the present invention is similar to that previously disclosed in connection with the description of the prior art. The improved device herein incorporates a spring biased lever which is constructed having a finger portion projecting outwardly from the lever and positioned in the path of rotation of the star wheel. The finger portion is formed having a camming surface and a shoulder abutment surface. The arrangement is such that one side of a star wheel tooth engages the camming surface of the finger portion upon rotation of the star wheel in the same direction of rotation of the ratchet wheel. Such rotation of the star wheel serves to displace the lever to a position which permits the finger portion thereof to ride over the apex of said tooth whereupon the spring biased lever moves back to a position to locate the shoulder abutment surface of the finger portion in contact with the opposite side of said star wheel tooth. The finger portion, thus, represents restraining means which is positioned to block or prevent counterrotation of the star wheel in the opposite direction. This, in turn, prevents counterrotation of the ratchet wheel in said opposite direction due to the engagement of the star wheel pin and the ratchet wheel pin, whereby the switch operating arm is held in its displaced position to prevent the inadvertent movement of the switch to its closed state.

Accordingly, an object of the present invention is to provide an improved control device for a coin operated mechanism having restraining means to prevent the inadvertent initiation of the operating cycle of the mechanism after the mechanism has completed a cycle of operation.

The above and other objects, features and advantages of the present invention will become more apparent from a consideration of the following detailed description when taken in conjunction with the accompanying drawings.

DESCRIPTION OF THE PREFERRED EMBODIMENT

Figure 1:
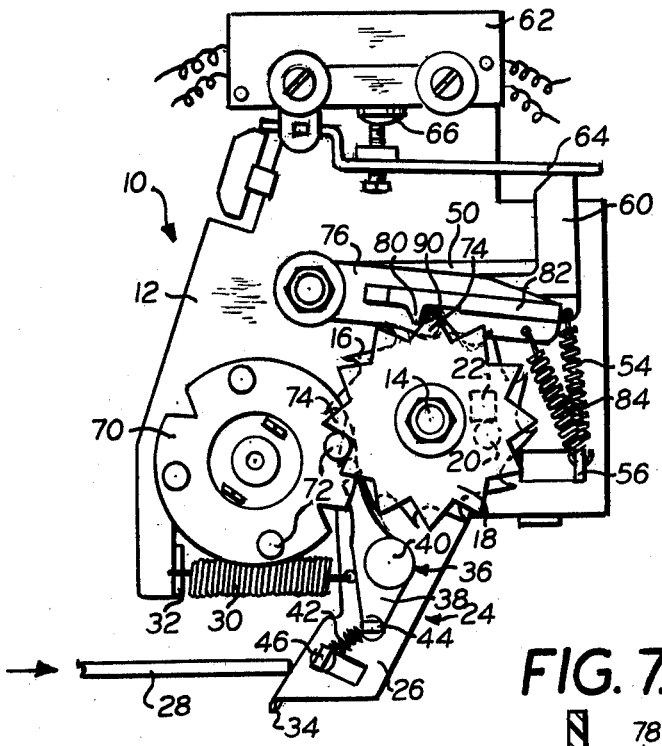
FIG. 1 is a front elevational view of the control device constructed in accordance with the present invention, and showing the switch displaced to its open state.

Referring to the drawings, numeral 10 represents a control device for a coin operated mechanism constructed in accordance with the present invention. In this regard, it will be assumed that the coin operated mechanism is of the type commonly referred to as a commercial appliance, such as, a clothes washer. In operation, upon the insertion of a preselected number of coins in the control device, the mechanism will operate through a conventional cycle.

Control device 10 is illustrated as including a mounting plate 12 having a fixed shaft 14 projecting outwardly therefrom. Rotatably mounted on shaft 14, in axially spaced relation, is a ratchet wheel 16 and a star wheel 18. A pin 20 projects outwardly from the front surface of ratchet wheel 16 and another similar pin 22 projects outwardly from the back surface of star wheel 18. Pins 20, 22 project toward one another and are located at equal radial distances from the axis of the shaft. The arrangement is such that pins 20, 22 are adapted to engage with one another at the end of the operating cycle of the mechanism in the manner hereinafter described.

Figure 2:
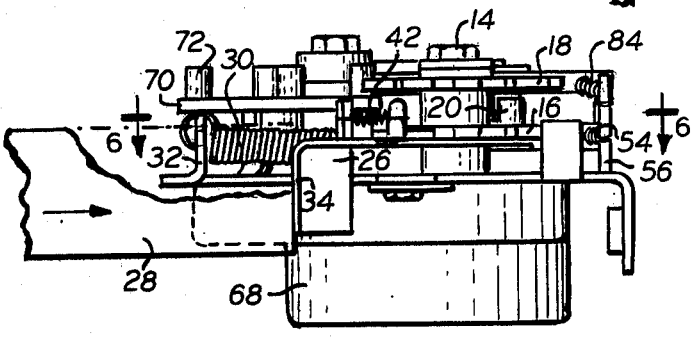
FIG. 2 is a bottom plan view thereof.

Stepping means, represented generally by numeral 24, is provided for rotating ratchet wheel 16, in a step-like manner, in a clockwise direction as viewed in FIG. 1. Stepping means 24 is illustrated as including an arm 26 oscillatably mounted on shaft 14 and operatively associated to the coin operated mechanism. In this regard, arm 26 is disposed for movement in a counterclockwise direction, as viewed in FIG. 1, upon projected movement of a coin slide 28 to its operate position. Projected movement of coin slide 28 is in a direction represented by the arrow in FIG. 1. Arm 26 is spring biased for movement in a clockwise direction by a spring 30 having one end connected to arm 26 and the opposite end connected to a post 32 on plate 12. The connection of spring 30 to arm 26 is effected by means of a suitable opening in the arm which accommodates or receives the said one end of the spring. Arm 26 is also formed having a bent leg portion 34 disposed in the path of movement of coin slide 28 as illustrated more clearly in FIG. 2. pp Stepping means 24 further comprises a pawl assembly, represented generally by numeral 36, which is illustrated as including a pawl 38 pivotally mounted on arm 26 by means of pivot pin 40. Pawl 38 is spring biased in a clockwise direction, as viewed in FIG. 1, by a spring 42 having one end connected to a post 44 on pawl 38 and the opposite end connected to a post 46 on arm 26. The arrangement is such as to locate the distant end of pawl 38 in engagement with the teeth 48 of ratchet wheel 16.

It will now be appreciated that upon projected movement of coin slide 28 to its operate position, arm 26 is rotated in a counterclockwise direction which causes the tooth engaging end of pawl 38 to ride on the surface of a ratchet wheel tooth 48. This effects a camming action of pawl 38 as it pivots about pin 40 against the force of spring 42. This action continues until the tooth engaging end of pawl 38 is positioned behind the next adjacent tooth 48 of the ratchet wheel 16. Then, upon retracted movement of coin slide 28, the arm 26 rotates in a clockwise direction, under influence of spring 30, and returns to its original position. Such rotation of arm 26 causes the pawl 38 to engage the ratchet wheel tooth 48 in a manner to effect clockwise rotation of ratchet wheel 16, in step-like manner, a distance of one tooth.

Figure 3:
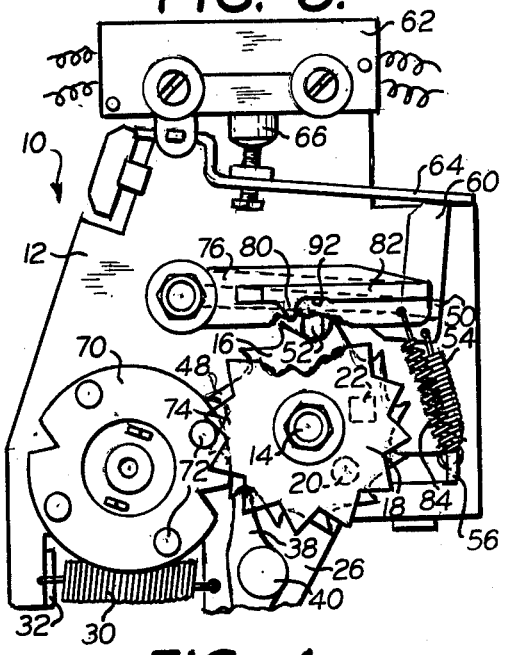
FIG. 3 is a view similar to FIG. 1, with parts broken away, showing the switch in its closed state.

Rotation of ratchet wheel 16 establishes an angular separation between ratchet wheel pin 20 and star wheel pin 22, as illustrated in FIG. 3. The extent of such separation will depend on the number of times that coin slide 28 is reciprocally operated which, in turn, is dependent on the number of proper coins necessary to operate the mechanism. In other words, the angular distance through which ratchet wheel 16 is advanced is translated into the operating cycle duration of the mechanism, as hereinafter described.

It will be further appreciated that stepping means 24 can be operatively connected to a solenoid assembly rather than a coin slide assembly to effect step-like rotation of ratchet wheel 16. An example of the use of a solenoid assembly to effect such rotation is disclosed in U.S. Pat. No. 3,172,520. Accordingly, the use of a coin slide assembly to effect operation of the stepping means herein is merely for purposes of describing a complete operation of the control device, and is not to be deemed a limitation on the invention.

Another arm 50 is pivotally mounted on plate 12 and is formed having a follower portion 52 engageable with the teeth 48 of ratchet wheel 16. Arm 50 is spring biased for movement in a clockwise direction, as viewed in FIG. 1, by a spring 54 having one end connected to arm 50 and the opposite end connected to a post 56 on plate 12. The connection of spring 54 to arm 50 is effected by means of a suitable opening 58 formed in the distant end portion of the arm which accommodates or receives the said one end of the spring. The arrangement is such that follower portion 52 rides over the teeth 48 of ratchet wheel 16 under the influence of spring 54. Arm 50 is further formed having a leg portion 60 operatively associated with a switch mechanism as hereinafter described.

Mounted on the plate 12 and spaced from arm 50 is a switch 62 having a pivotally mounted armature 64 engageable with the leg portion 60 of arm 50. Switch 62 is provided with an operating button 66 which is normally biased outwardly by an appropriate spring (not shown). The button is adapted to be depressed against the force exerted by the biasing spring to change the state of the switch. In other words, if the switch is connected to be normally closed when the button is biased outwardly, then the switch will be moved to an open state when the button is depressed. Switch 62 is adapted to be connected in circuit to initiate the operating cycle of the mechanism when the switch button is displaced outwardly to render the switch in its closed state.

Referring to FIG. 3, it is to be noted that when switch 62 is in its closed state, the follower portion 52 of switch operating arm 50 is located in the space between adjacent teeth 48 of ratchet wheel 16. It thus follows that in order to effect movement of switch 62 to its open state, switch operating arm 50 must be rotated in a counterclockwise direction to effect similar counterclockwise rotation of armature 64 due to its engagement with the leg portion 60 of said arm to effect inner displacement of button 66. Such movement of button 66 effects movement of switch 62 to its open state to terminate the operating cycle of the mechanism.

The length or duration of the operating cycle is controlled by an electrically operated timer mechanism 68 mounted on plate 12. The timer mechanism has an energizing circuit that is controlled by switch 62. In other words, movement of switch 62 to its closed state also serves to energize timer mechanism 68. The timer mechanism has a motor which turns at a uniform rate of speed and is provided with an output shaft. Fixedly connected to the timing motor shaft is a pin wheel 70 having a specific number of pins 72 spaced equidistant along its periphery. The number and location of pins 72 is selected in accordance with the desired time of operation of the coin operated mechanism for each coin insertion into slide 28.

Figure 5:
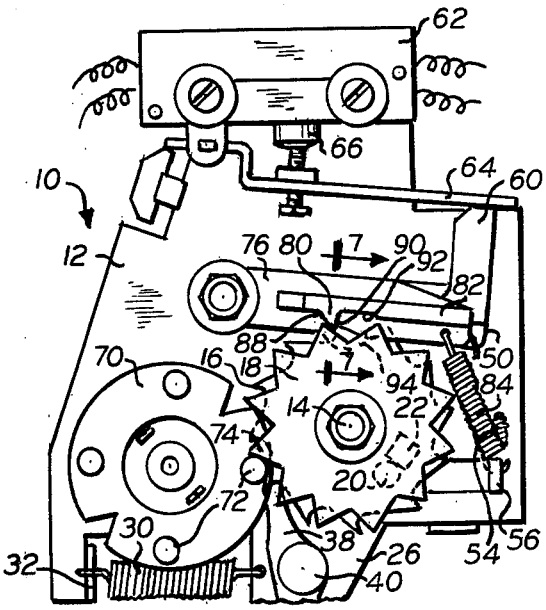
FIG. 5 is a view similar to FIG. 3 showing the star wheel and ratchet wheel operatively connected for conjoint rotational movement immediately prior to the displacement of the switch to its open state.
Figure 6:
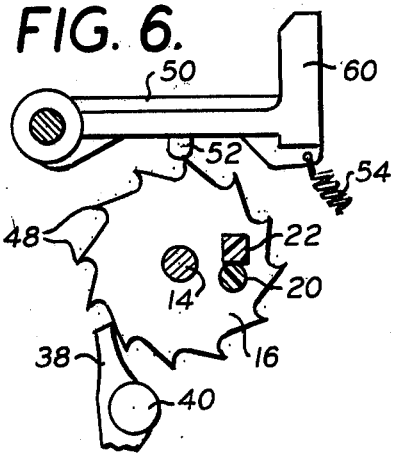
FIG. 6 is a sectional view taken along line 6—6 of FIG. 2.

The arrangement is such that as pin wheel 70 rotates in a counterclockwise direction, the pins 72 engage with the teeth 74 of star wheel 18 to intermittently rotate said star wheel in the same clockwise direction of rotation as ratchet wheel 16. In other words, each time a pin 72 engages a tooth of star wheel 18, the wheel is advanced one tooth in a clockwise direction. Pin wheel 70 thus represents stepping means operable when switch 62 is in its closed state for rotating star wheel 18. When the number of such periodic advances equal the total advance of ratchet wheel 16 by stepping means 24, then star wheel 22 engages with the ratchet wheel pin 20, as shown in FIG. 5. Thereafter, on the next engagement of a pin 72 with a star wheel tooth 74, star wheel 18 and ratchet wheel 16 are rotated conjointly in said clockwise direction due to the engagement of pins 20, 22. Such rotation of ratchet wheel 16 serves to rotate switch operating arm 50 in a counterclockwise direction whereby follower portion 52 is displaced to the outer end of a ratchet wheel tooth 48, as shown in FIG. 6. Such rotational movement of switch operating arm 50 serves to effect movement of switch 62 to its open state, in the manner heretofore described, to de-energize the timer 68 and terminate the operating cycle of the mechanism.

It will now be appreciated that if star wheel 18 is permitted to rotate in a counterclockwise direction when switch 62 is in its open state, then ratchet wheel 16 will also be permitted to similarly rotate in a counterclockwise direction under the influence of the spring biased switch operating arm 50. Such movement of the switch operating arm 50 will also permit movement of switch 62 to its closed state to thereby inadvertently initiate the operating cycle of the mechanism. Thus, the mechanism may be subjected to unauthorized use without first depositing the proper coin or coins in the control device. It will be further appreciated that it only takes a slight degree of rotational play of pin wheel 70 and star wheel 18 to inadvertently initiate the operating cycle of the mechanism.

In accordance with the teachings of the prevent invention, a lever 76 is pivotally mounted on plate 12 having restraining means, represented generally by numeral 78, located to engage one of the teeth 74 of star wheel 18 to prevent rotation of said wheel in a counterclockwise direction when switch 62 is in its open state. Restraining means 74 comprises a finger portion 80 projecting outwardly from lever 76 and positioned in the path of rotation of star wheel 18. In the preferred embodiment, lever 76 has a front surface lying in a plane substantially perpendicular to the axis of the shaft 14. The lever is formed having a raised portion 82 projecting outwardly from its front surface and extending longitudinally thereof. From the viewpoint of manufacturing the lever, finger portion 80 is formed integrally with the projecting portion 82.

Lever 76 is spring biased for movement in a clockwise direction by a spring 84 having one end connected to lever 76 and the opposite end connected to the post 56 on plate 12. The connection of spring 84 to lever 76 is effected by means of a suitable opening 86 formed in the distant end portion of the lever which accommodates or receives the said one end of the spring. The arrangement is such that lever 76 is disposed for movement from a rest position, as shown in FIG. 1, to a displaced position which permits the finger portion 80 to be moved to a position to block or prevent counterrotation of star wheel 18 in the manner hereinafter described.

Finger portion 80 is formed having a camming surface 88 and a shoulder abutment surface 90. In operation, rotation of star wheel 18 in a clockwise direction by means of the stepping pin wheel 70 causes one side of a star wheel tooth 74 to engage the camming surface 88 of finger portion 80 to effect rotation of lever 76 in a counterclockwise direction. Such rotation is tantamount to movement of lever 76 to a displaced position which permits finger portion 80 to ride over the apex of said star wheel tooth 74, whereupon lever 76 moves back to its rest position, as shown in FIG. 1, under influence of spring 84. Such movement of lever 76 is snap-like in its action which results in a force being exerted on the opposite side of said star wheel tooth 74 to effect continued clockwise rotation of star wheel 18 in a rapid-like fashion. This, in turn, effects clockwise rotation of ratchet wheel 16, in rapid-like fashion, due to the engagement of pins 20, 22. The rotation of ratchet wheel 16 in the manner described serves to effect movement of switch 62 to its open state, in snap-like fashion.

Movement of lever 76 in the manner described also serves to locate the shoulder abutment surface 90 of finger portion 80 in position relative to the opposite side of said star wheel tooth 74 to prevent rotation of said star wheel in a counterclockwise direction when switch 62 is in its open state. In this regard, any significant counterclockwise rotation of star wheel 18 serves to locate the opposite side of said star wheel tooth 74 in contact with the shoulder abutment surface 90 of finger portion 80. It thus follows that ratchet wheel 16 will also be prevented from rotating in a counterclockwise direction by means of the engagement of ratchet wheel pin 16 and star wheel pin 18. This, in turn, results in the follower portion 52 of switch operating arm 50 being held in its displaced position on the outer end of a ratchet wheel tooth 48 when switch 62 is in its open state to prevent the inadvertent movement of said switch to its closed state.

Figure 7:
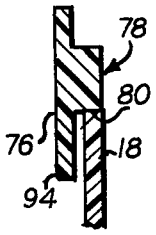
FIG. 7 is a sectional view taken through line 7—7 of FIG. 5.
Figure 4:
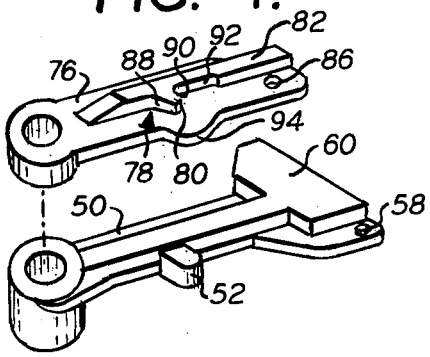
FIG. 4 is an exploded perspective view of the switch operating arm and the star wheel restraining lever.

The projecting portion 82 of lever 76 is formed having a recessed surface 92 located to provide clearance for the star wheel teeth 74 and to permit unobstructed rotation of star wheel 18 in a clockwise direction. Lever 76 is further formed having an outwardly projecting portion 94 disposed to continuously overlie a segment of the back surface of star wheel 18, as shown in FIG. 7, in all positions in the path of pivotal movement of lever 76 from its rest position to its displaced position. The overlying portion 94 serves to prevent lateral displacement of lever 76 in a direction away from plate 12. In other words, vertical alignment of lever 76 with star wheel 18 is maintained to assure that finger portion 80 properly engages with the teeth 74 of said wheel.

There is thus provided an improved control device for a coin operated mechanism having novel restraining means to prevent the inadvertent initiation of the operating cycle of the mechanism after the mechanism has completed a cycle of operation. While a preferred embodiment of the invention has been shown and described in detail, it will be readily understood and appreciated that numerous omissions, changes and additions may be made without departing from the spirit and scope of the present invention.

I claim:

1. A control device for a coin operated mechanism, said device comprising:

(a) a mounting plate;

(b) a shaft projecting from said mounting plate;

(c) a ratchet wheel and a star wheel rotatably mounted on said shaft in axially spaced relation, each of said wheels having a pin thereon projecting toward the other wheel, and said pins each being located at an equal radial distance from the axis of said shaft;

(d) first stepping means oscillatably mounted on said shaft and operatively connected to the coin operated mechanism, said stepping means comprising a pawl assembly engagable with the teeth of said ratchet wheel to step-wise rotate said wheel in one direction by a distance of one tooth upon movement of said stepping means;

(e) switch means mounted on said plate having a switch movable from a normally closed state to an open state;

(f) a spring biased switch operating arm pivotally mounted on said plate and operatively connected to said switch, said arm having a follower portion engagable with the teeth of said ratchet wheel;

(g) said switch being in its closed state when the follower portion of said switch operating arm is located between the teeth of said ratchet wheel, and said switch being moved to its open state when said follower portion is displaced to the outer end of a tooth of said ratchet wheel;

(h) an electrically operated timer mounted on said plate having an energizing circuit controlled by said switch, said timer comprising second stepping means operable when said switch is in its closed state to engage with the teeth of said star wheel and intermittently rotate said star wheel in the same direction of rotation of said ratchet wheel, such rotation of said star wheel causing the pin thereof to engage with the pin of said ratchet wheel;

(i) the follower portion of said switch operating arm being displaced to the outer end of a tooth of said ratchet wheel upon conjoint rotation of said star wheel and said ratchet wheel in said one direction by the engagement of said pins to open said switch; and (j) a spring biased lever member pivotally mounted on said plate and engagable with said star wheel, said lever having restraining means located to engage one of the teeth of said star wheel upon said conjoint rotation of said star wheel and said ratchet wheel to prevent counterrotation of said star wheel in a direction opposite to said one direction when said switch is in its open state, the engagement of said pins preventing counterrotation of said ratchet wheel in said opposite direction wherein said switch follower portion is held in its displaced position on the outer end of said ratchet wheel tooth to prevent the inadvertent movement of said switch to its closed state.

2. The control device as recited in claim 1, wherein said lever is disposed for movement from a rest position to a displaced position; said restraining means comprising a finger portion projecting outwardly from said lever and positioned in the path of rotation of said star wheel, said finger portion having a camming surface and a shoulder abutment surface; one side of said star wheel tooth engaging the camming surface of said finger portion upon rotation of said star wheel in said one direction to move said lever to its displaced position and permit said finger portion to ride over the apex of said tooth, whereupon said lever moves back to its rest position to locate the shoulder abutment surface of said finger portion in contact with the opposite side of said tooth to prevent counterrotation of said star wheel in said opposite direction when said switch is in its open state.

3. The control device as recited in claim 2, wherein said lever has a surface lying in a plane perpendicular to the axis of said shaft; said lever further having a portion projecting outwardly from said surface and extending longitudinally thereof; said finger portion being formed integrally with the projecting portion of said lever.

4. The control device as recited in claim 3, wherein the projecting portion of said lever has a recessed surface located to provide clearance for said star wheel tooth when said lever is in its rest position.

5. The control device as recited in claim 2, wherein said star wheel has a front surface and a back surface; said lever having a portion continuously overlying a segment of one of said star wheel surfaces in all positions in the path of pivotal movement of said lever from its rest position to its displaced position to prevent lateral displacement of said lever in a direction toward the other one of said star wheel surfaces.

* * * * *